US006227453B1

(12) United States Patent
Calvin et al.

(10) Patent No.: US 6,227,453 B1
(45) Date of Patent: May 8, 2001

(54) ATMOSPHERIC LIQUID HEATER

(76) Inventors: Donald R. Calvin, 901 Copper St., Leadville, CO (US) 80461; Thomas B. Calvin, Forest Hill Rd., Forest Hill, WV (US) 24935

( * ) Notice: Subject to any disclaimer, the term of this patent is extended or adjusted under 35 U.S.C. 154(b) by 0 days.

(21) Appl. No.: 09/303,402

(22) Filed: May 1, 1999

Related U.S. Application Data

(62) Division of application No. 09/106,911, filed on Jun. 29, 1998.

(51) Int. Cl.[7] ..... F24D 5/10
(52) U.S. Cl. ..... 237/69; 237/12.3 B
(58) Field of Search ..... 237/69, 66, 56, 237/12.3 B

(56) References Cited

U.S. PATENT DOCUMENTS 5,181,655 * 1/1993 Bruckelmyer ..... 237/1 R
5,292,065 * 3/1994 Fiedrich ..... 237/69

* cited by examiner

*Primary Examiner*—Harold Joyce
*Assistant Examiner*—Derek S. Boles
(74) *Attorney, Agent, or Firm*—Lee G. Meyer; Snell & Wilmer, LLP

(57) ABSTRACT

A mobile heating system for providing hot liquids is provided. System includes a trailer mounted liquid heater, an exit manifold for distribution through hoses, a return system communicating with a return manifold in communication with a return reservoir for storing heated liquid such that by providing incremental heat through the liquid heater to the return material sufficient energy is maintained to allow atmospheric 220+ degree liquid to be circulated within the system. In one aspect of the system, by means of contact with the hot hoses, a substance is used for thawing ground, heat, melting snow and ice, curing cement, and the like. In another aspect, the liquid is water used to provide for example, hygienic liquid or hot water for field showers. In a further aspect, the apparatus can be hooked into the hose line to provide for example, radiated heat for convection into space, such as in construction of a building, house and the like.

7 Claims, 5 Drawing Sheets

ATMOSPHERIC LIQUID HEATER

This application is a divisional of Ser. No. 09/106,911 filed Jun. 29, 1998.

BACKGROUND OF THE INVENTION

1. Field of Invention

This invention relates to atmospheric liquid heaters; and, more particularly to portable atmospheric heaters for recirculating super heated aqueous solutions.

2. Description of Related Art

In cooler climes such as northern and southern regions of the globe, as well as in high altitudes, such as the Rocky Mountain areas, there is need for portable heater devices. Although there are many portable heaters in many aspects, these heater systems suffer from one or more problems which render them deficient in supplying the quality and quantity of heated liquid required. While a number of pressurized boilers for providing heated steam/water mixtures exist, they are somewhat complicated, require pressurized vessels and are expensive to build and maintain. Additionally, housing pressurized vessels, pump valves and the like becomes somewhat difficult if the system is to be mobilized especially, in mountainous areas where roads are inferior and spaces where the systems are to be utilized have limited access.

One of the problems with most atmospheric boilers is that, as the altitude increases, the temperature at which the liquid boils decreases. Thus, in order to achieve elevated liquid temperatures at atmospheric pressure, it has been necessary to employ boiling point elevators to increase the liquid temperature at which the liquid boils. These substances can cause corrosion as well as limit the use of the heater system. Pure water is necessary for field showers and the like. Use of boiling point enhancers may be toxic.

Additionally, in for example, high altitude or northern construction, it is necessary to melt or thaw the ground, for example, to dig trenches, foundations, lay wire, pipe cure concrete, and the like during the winter months. Further in these climes, it is necessary to have a device which is portable to remove ice and snow from for example, shelter and sheds nestled in mountain terrain. Finally, it is necessary to have portable heating devices for construction of buildings, houses and the like in these remote inclimate locations, so that workman can have an atmosphere which supports a work environment without the necessity of multi layers of clothes which hinder mobility.

Heretofore, a number of devices have been available to do one or more of the aforementioned tasks, but none have been versatile enough to truly meet all of the above needs. For example, U.S. Pat. No. 5,181,655, for "Mobile Heating System" issued to Mark Bruckelmyer on Jan. 26, 1993 provides for a mobile heating system for thawing ground for construction which involves pumping heated water from a reservoir through hosing to a plurality of elongated heater probe which are driven into the ground or the substance to be thawed. Generally, this patent discloses a heating system for thawing frozen ground or building materials, such as bricks. The invention includes a heater for heating fluid which is circulated by a pump through a connected line which is in fluid communication with a plurality of elongated heater probes adapted to be implanted in the ground. An antifreeze reservoir is connected to the line for pumping antifreeze into the line to protect it and the probe from freeze damage when not in use.

This system has a number of draw backs including the necessity of driving the heating probes into the frozen earth.

Likewise, U.S. Pat. No. 5,567,085 issued to Bruckelmyer on Oct. 22, 1996 uses a circulation hose that is covered with a aggregate to be placed into a form from which concrete is poured. The hot fluid circulating in the hose covered by the aggregate becomes part of the concrete structure in one embodiment and the hose is severed at its exit point from the concrete forms. Neither of these systems employ a booster recirculating type reservoir system to provide fast recovery and large heat capacity for incrementally super heating the water before it is returned to the system with a high gained heater. In addition, these systems are not designed for high capacity such as providing hot water for field showers, hygienic purposes for forest services and the like. Thus, it would be advantageous to have a high capacity atmospheric transportable system to provide hot water and heat to remote and undeveloped sites, locations in construction or development stage, whether for space heating, drying and curing concrete plaster, paste, or the like or for simply melting ice and snow and thawing earth for forms laying wire conduit pipe and the like.

U.S. Pat. No. 4,491,113, for "Probe for Circulating Heated Water" issued to Mark Bruckelmyer on Sep. 12, 1995 generally discloses an insertable thawing probe for circulating heated water for thawing frozen ground as a portion of a mobile heating system. The probe includes a T connection having a fluid inlet section, and a fluid outlet section. The probes are generally used for insertion into frozen ground for thawing in area proximate to the frozen sewer or water line.

U.S. Pat. No. 5,567,085, for "Method of Thawing Frozen Ground for Laying Concrete" issued to Mark Bruckelmyer on Oct. 22, 1996, is directed toward a method for thawing frozen ground for the purpose of laying concrete wherein a continuous length of circulating hose is placed on the frozen ground either inside or adjacent the concrete form where the concrete is to be poured and then the hose is covered with a layer of aggregate material for insulation. In one aspect, this method invention is for circulating warm liquid through a circulating hose inserted into pored to prevent freezing while the concrete hardens. A disclosed advantage is that this method of thawing frozen ground to lay concrete does not require removal of the hose prior to actually laying the concrete.

SUMMARY OF THE INVENTION

A mobile atmospheric unit for heating liquid, and preferably aquatic liquid, comprising of a high heat capacity liquid heater; a multiple conduit exit manifold; at least one conduit for circulating the hot liquid communicating with the exit manifold; an intake manifold which communicates with the at least one conduit for circulating the hot liquid; a return reservoir which communicates with said intake manifold and the high heat capacity liquid heater. The return reservoir incrementally feeds the liquid to the high heat capacity liquid heater. The device maximizes heat efficiency and fuel economy by reusing hot fluids through a circulation system that uses at least one hose, each of which returns hot liquid to the return reservoir and then incrementally to the liquid heater for reheating and re-distribution. The device permits appliances such as metal conduit and radiators to be spliced into the hose lines.

In one embodiment, a biodegradable type freezing point depression solution is used to prevent freezing of the lines if device is idled. The solution is used to avoid contaminating the liquid, liquid heater, hoses, reservoir or the environment in case of a line break or spill. The device supplies heat to thaw ground for water drainage, excavation and trenching purposes, heat fluids in storage tanks, pipelines, holding ponds, and swimming pools. The device melts ice or spilled products on frozen terrain in almost any location. The device allows one, two or three lines to be independently shut down. Lines may be pumped out and be emptied at the time of relocation or the moving of the trailer. This allows for lighter, more flexible and more maneuverable lines for lifting, redistribution, or take up.

In accordance with one embodiment, the conduit can be easily and efficiently cleared of liquid so the hoses may be reeled, stored or moved. In another embodiment the liquid is water for use in personal hygiene, mobile kitchens, facility cleaning and the like. In another embodiment the liquid circulating through a conduit circulates through at least one radiation type device, which either alone, or in combination with some forced air device, provides space heating for remote edifices.

The device of the instant invention is broadly a mobile atmospheric hot liquid heater apparatus with a number of uses. In one configuration, it can supply hot water for use in, for example, remote or field personal hygiene or facility cleanup such as for a Forest Service camp site. In a second configuration, the device can provide heated liquid to a heat exchanger, such as to provide remote or emergency facility interior space heating or the like. In yet another configuration, the device can be used to thaw ground for trenching, digging foundations, working on roadways or curing concrete in cold weather. In another configuration, the device can be used to heat and dry wet ground or travel ways to avoid carrying mud, solids, etc. from one location to another, to save money by eliminating the transportation of fill dirt or soils which actually add to the problem, resulting in slow downs and the prolonging of construction time.

DETAILED DESCRIPTION OF THE DRAWINGS

Figure 1:
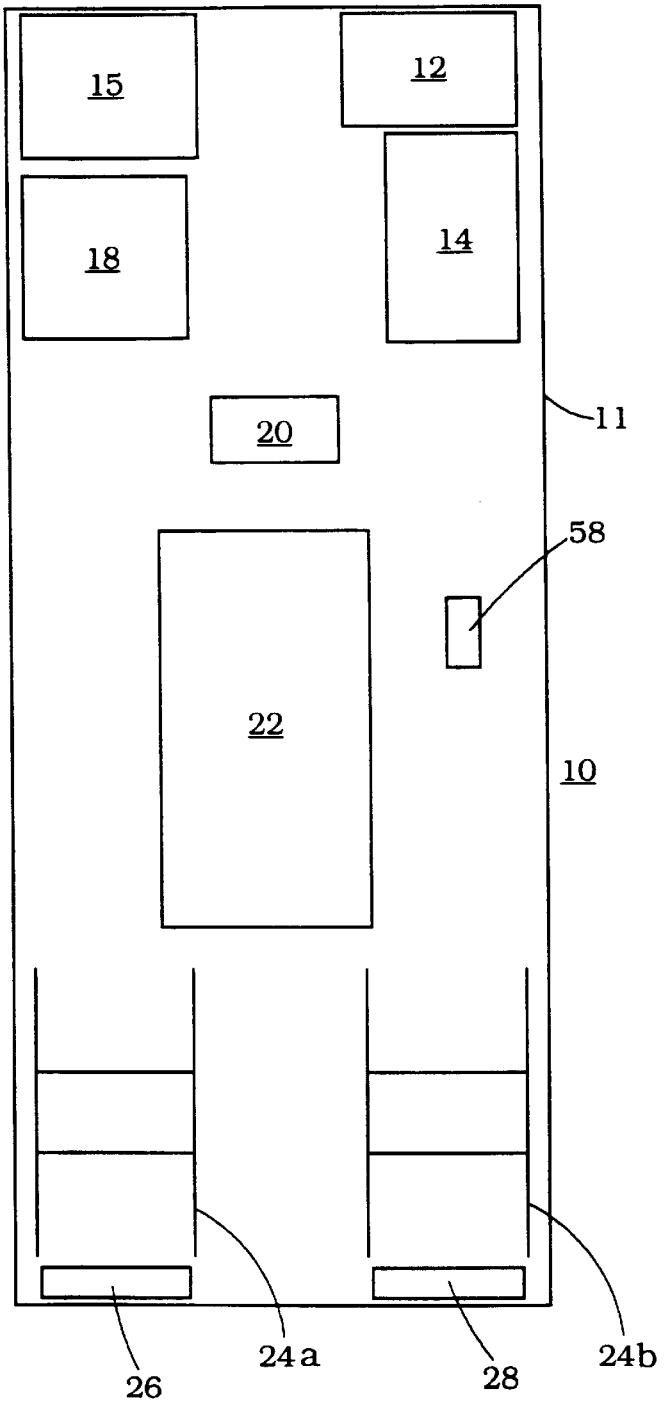
FIG. 1 is an illustrative top view of the layout of the device in accordance with the instant invention.

Turning to the drawings where like numbers designate like apparatus or elements, there is shown in FIG. 1 the device of the instant invention 10. There is shown device 10 situated on a trailer 11 and having components as follows: in spaced apart relationship, as indicated in FIG. 1 and more specifically shown as a layout in FIGS. 5 and 6. Trailer 11 contains an air compressor 12, a generator 15, a diesel fuel tank 18, a liquid reservoir 14, which is a non-closed storage system, a liquid pump 20, a liquid heater 22, an electrical panel 58, hose reals 24*a* and 24*b*, a return manifold 26 and an exit manifold 28.

Figure 2:
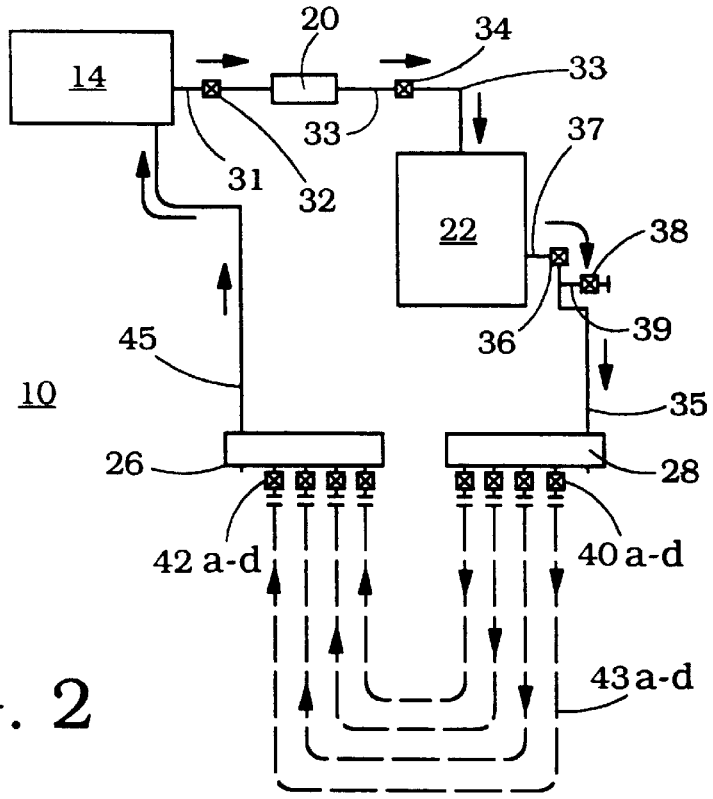
FIG. 2 is a flow chart of the liquid flow of the heated liquid in accordance with the instant invention.

Turning to FIG. 2, there is shown a flow diagram of liquid in accordance with the instant invention 10. The liquid flows from the liquid reservoir 14, through exit connection transfer pipe 31 through one way valve 32 communicating with liquid pump 20, from liquid pump 20, through pipe 33 through a one way valve 34 communicating with entry of liquid heater 22. The hot liquid exits liquid heater 22, through exit pipe 37 and through valve 36 into exit manifold 28 through valves 40*a–d* into hoses 43*a–d*. The liquid reenters through valves 42*a–d* into return manifold 26 emptying through pipe 45 into liquid reservoir 14. Air is forced into the system to expel any liquid through intake valve 38 and pipe 39.

Figure 3:
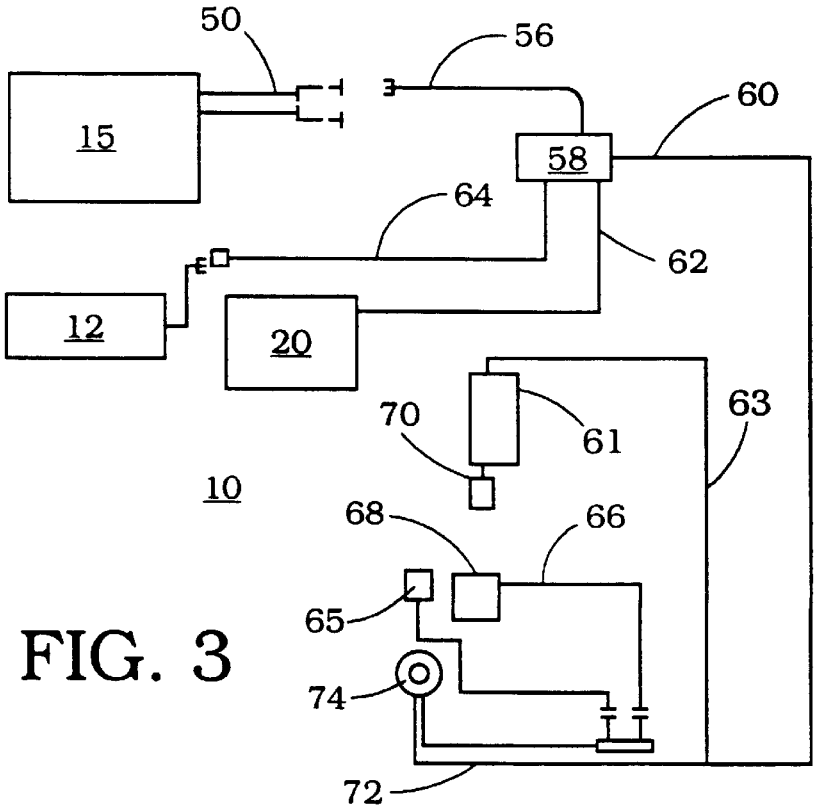
FIG. 3 is an electrical diagram of the circuitry in accordance with the instant invention.

Turning to FIG. 3, there is shown the electrical circuitry configuration of the invention 10. A generator 15 is configured to produce two 240 volt outlets 50. In accordance with the invention, the device 10 can be hooked to the utility power lead 56 rather than the generator 15. The utility power lead 56 communicates electrically with an electrical panel 58 which distributes a 240 volt current through line 60 through line 62 to pump 20 and a 120 volt current through line 64 to air compressor 12. Line 63 provides a 115 volt current to the blower motor 61 and the Diesel Fuel pump and regulator 70. Line 66 provides a 240 volt electric supply to the ignition head supply transformer 68 by means of a 115 volt connection line 72 to thermostat 74.

Figure 4:
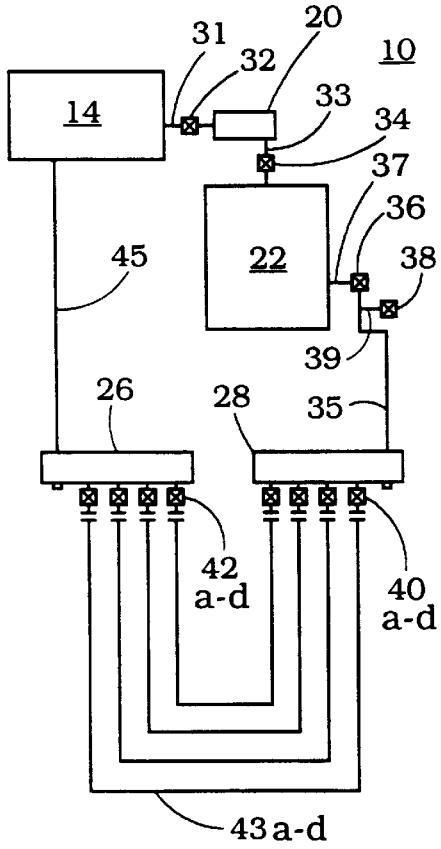
FIG. 4 is an operating schemata of the device in accordance with the instant invention.

Turning to FIG. 4, there is shown a procedure for operation of the instant invention 10. Liquid from the liquid reservoir 14 travels through exit connection transfer pipe 31 through one way valve 32 to liquid pump 20 through pipe 33 to one way valve 34 and to liquid heater 22, follows exit pipe 37 to valve 36 through hose 35 to exit manifold 28. Air enters through intake valve 38 and pipe 39. The liquid then flows through valves 40A–D through hoses 43A–D to valves 42A–D into return manifold 26 and into pipe 45 back to liquid reservoir 14.

Figure 5:
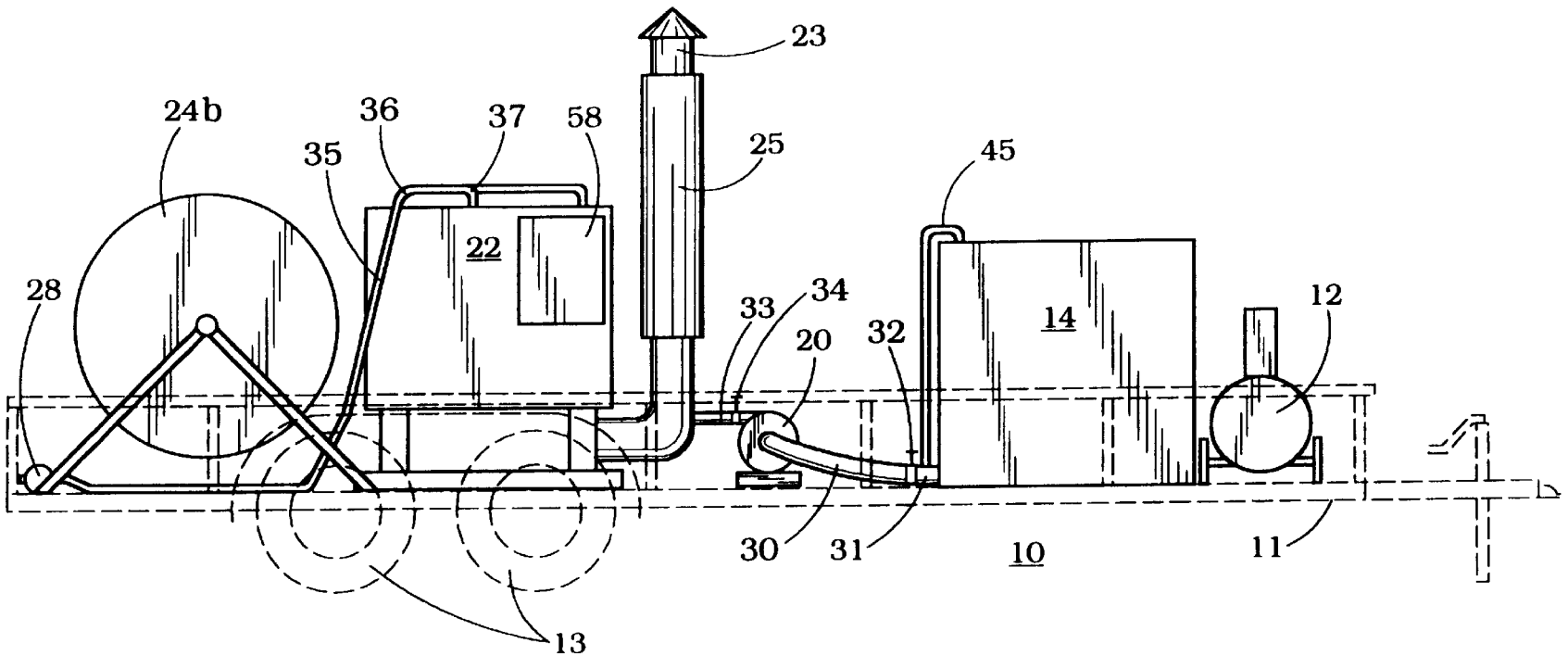
FIG. 5 is a right hand side view of the apparatus in accordance with the instant invention.

Turning to FIG. 5, the instant invention 10 is shown. The trailer 11 is placed on steel wheels in the standard trailer pattern 13. The air compressor 12 is located to the rear of the trailer 11 and is placed in front of the liquid reservoir 14. This is connected through the pipe 45. From the liquid reservoir 14, liquid flows from exit connection transfer pipe 31 from valve 32 and from hose 30 to the liquid pump 20. From there the liquid flows into one way valve 34, through pipe 33 and into the liquid heater 22. Attached is an exhaust stack 23 covered by a safety guard 25. Also attached is the electrical panel 58. The liquid flows through the exit pipe 37, through valve 36 and through hose 35. From there it passes into the exit manifold 28 and into the hoses on reel 24*b*.

Figure 6:
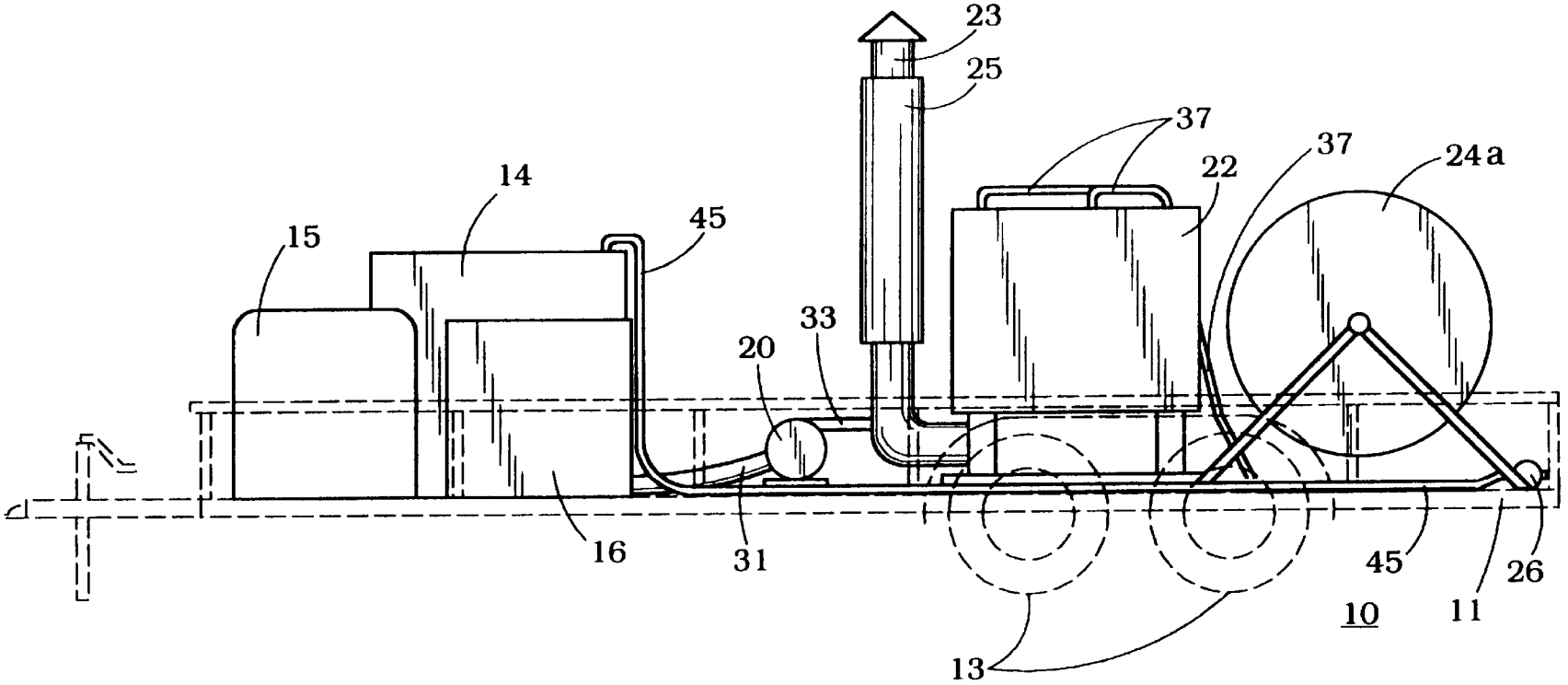
FIG. 6 is a left hand side view of the apparatus in accordance with the instant invention.

Turning to FIG. 6, the opposite side of the instant invention 10 is shown. The trailer 11 and steel wheels in standard trailer configuration 13 are again shown. The liquid flows through the hoses on reel 24*a* and returns through the return manifold 26. It then flows through pipe 45 to the liquid reservoir 14. Liquid flows between the liquid heater 22 through exit pipe 37. The exhaust pipe 23 is covered by the safety guard 25. Pipe 33 allows for liquid to run from the liquid pump 20 which is fed by the exit connection transfer pipe 31. The diesel fuel tank 18 and the generator 15 supply power to the system 10.

Figure 7:
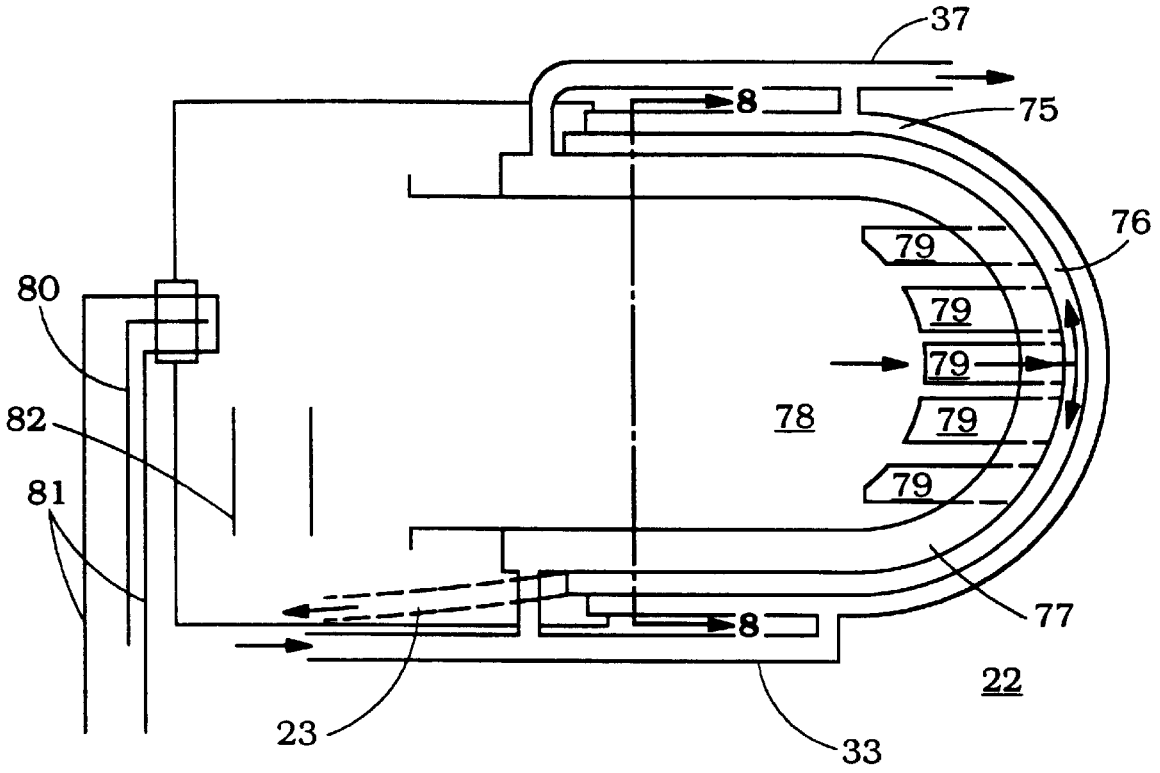
FIG. 7 is a longitudinal cross section of the liquid heater device in accordance with the instant invention.

Turning to FIG. 7, a cross section of the liquid heater 22 is shown. Pipe 33 passes liquid into the primary liquid chamber 77 and the secondary liquid chamber 75. Heat is then passed from the primary heat chamber 76 through the heat passages 79 though the primary liquid chamber 77 and into the secondary heat chamber 76. The heated liquid exits through the hose 37. Combustion air enters through the intake 82 and exhaust is expelled though the exhaust pipe 23. Two lines 81 supply the system with power, and the system is also supplied by a fuel line 80.

Figure 8:
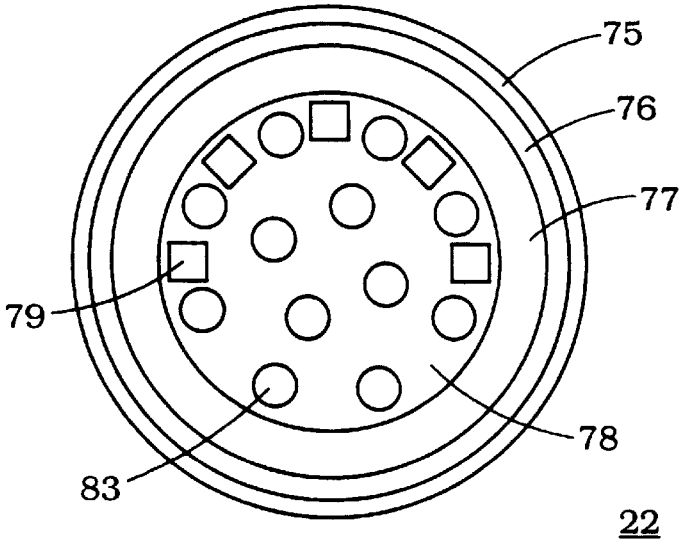
FIG. 8 is a cross section of the liquid heater device along lines 8-8 in FIG. 7.

Turning to FIG. 8, another cross section of the liquid heater 22 is shown. The liquid flows through the primary liquid chamber 77 and the secondary liquid chamber 75 as well as the liquid sleeves 83. The heat is passed around the liquid through the primary heat chamber 78, the secondary heat chamber 76 and the heat passages 79.

Liquid Reservoir

The liquid reservoir has a 2 inch inlet for filling, which has a tee handle and holes drilled in the top of the cap. This cap is removed during operation, to allow steam to escape, preventing pressure buildup. The reservoir also has a 1¼ inch inlet for return of liquid from the return manifold. A sight gauge is located on the front side of the reservoir, facing the liquid heater, to show any fluid loss and to help insure that the pigging device has traveled though the system and is finished pushing fluid out of the line it has been inserted into. Each inch on the sight gauge, indicates 2½ gallons of liquid. This tank has a 90 gallon capacity, the hose can hold 46.5 gallons and the pump, liquid heater and piping can hold approximately 14 gallons.

Liquid pump

A liquid pump is set between the liquid reservoir tank and the liquid heater. The pump is connected to the liquid heater inlet by a valve containing a pressure sensitive switch and pressure gauge to regulate pressure settings and shut down the pump in case an over pressure situation arises.

The High Heat Capacity Liquid Heater

The of the instant invention is a high heat capacity unit. The fuel used therein is diesel type #2, heating oil#1, diesel or kerosene and the unit is capable of being converted to LP gas or natural gas. The liquid heater uses 3 gallons of fuel per hour while operating on diesel fuel. The liquid heater has a pressure relief valve and an alarm in case of over heating. The steel fuel tank has a 2 inch filler pipe which the fuel line screws into and it extends into the tank within ½ inches of the bottom of the tank. The fuel tank has a 90 gallon capacity. The tank also has a sight gauge on the side facing the liquid heater, with an inch representing 2½ gallons of fuel. The fuel pump operates at 120 PSI and is connected to the fuel tank by two lines, a feed line and a return line. The liquid heater is connected to the liquid pump by an inlet valve on the liquid heater. A 1¼ inch exit valve is installed on the liquid heater to control when liquid leaves the liquid heater. This exit valve includes a connection for air installation which will only push into the exiting lines back into the liquid reservoir.

Liquid Manifolds

A 1¼ inch hose 10 feet in length starts at the liquid heater's exit valve and air connection and continues to the manifold at the back of the trailer, where connections for the hoses start. The 3 inch steel pipe manifolds are 24 inches in length, have four ¾ inch connections and one 1¼ inch connection with a plug inserted. This ¼ inch on the manifolds allows for a test hose to run the liquid heater, without connecting 500 feet (minimum) of hose and also allows this size connection, if so desired. Some uses would only want one line and this is the same size as the outlet piping on the liquid heater. Each ¾ inch connection at the manifolds, have a ball valve, are color coded to identify which hose is being connected and when it is time to drain the hose system, will allow the correct installation of the pigging device. The other end identifies on which line to install the pig device catcher. The two manifolds are alike, in reverse order. Each hose has a color coded connector and can either fit hose to hose or on the manifold connection at the valves. For operational purposes, there is no difference as to which end fits which connector, however, it is important when transferring the liquid from the hose to the reservoir. Once the fluid has reached the manifold returning the flow to the reservoir, a 1¼ inch hose connects to the manifold and the reservoir.

The Lines

Hose and Reels; Each Reel Capacity: 1000 feet (+); Hand Reel Type

Hose Size: 0.75 in. ID 1.100 in. OD

Liquid Capacity 1 Gallon per 43 Ft 11.6 Gallon per 500 feet

Spec: Goodyear Brand

Maximum:150 PSI 250 Degree Fahrenheit

500 Ft. per Lateral (4 laterals×500 Ft.=2000 Ft. Total Length)

When not in use, the hoses are to be empty of all liquid solution. To set up the device in a location, the color coded connections at the Liquid Manifold below hose reels and pulling line off with distribution of line beginning at trailer and actually distributing two lines, the end is connected to manifold with other end still on reel, and at the point the other end comes off the reel, it is connected to the return manifold and the process is started again, until all four lines have been taken off the reel. To obtain the most efficient performance, all hoses should be used. The lines are returned to the reels by reversing the above procedure.

The Liquid

When providing heat from external surfaces of liquid carriers, the unit uses a biodegradable type solution for freeze protection, to avoid contaminating the liquid heater, hoses, reservoir and prevent extra cleanup in case of a line break spill.

Electric System

The electric system has a 5000 watt generator (gasoline powered) for use in remote areas without available electricity. Fuel capacity, under maximum load, is limited to 9½ hours. The system can only be connected to one electric source, generator or utility company. 240 v Equipment; 1½ zHP Liquid Pump Transformer for Liquid Heater Electronic Ignition (10,000 v Sec). 1.15 v Equipment comprises: heat Exchange Blower Motor; Liquid Heater Thermostat; Liquid Heater Alarms—(High temp/High pressure)

The system also supports a 5 HP, 20 gallon Air Compressor.

In Operation

Procedure for Operation of System comprises the steps of:

Valves 32 and 34 are opened; Pump 20 is turned on; Liquid Heater 22 is turned on; the temperature is raised in Liquid Heater 22 to 160 degrees; Valve 36 is then opened; one valve 40*a–d* on manifold 28 is opened; the same lateral hose line is opened at valves 42*a–d* on manifold 26.

In a period of 1½ to 2 minutes, the connection at manifold 28 has warm liquid returning, the remaining valves are opened, one at that time, at manifold 28 and manifold 26 in the same procedure. After running 15 to 25 minutes, liquid returning will have all system liquid at high enough temperature and the liquid heater 22 will begin auto shut down and start to heat liquid to thermostat 74 setting. The liquid returning will be within 8 to 10 degrees of the liquid exiting liquid heater 22 for approximately 20 minutes and will then be within 5 degrees within an hour.

To empty the line, the pump 20 and liquid heater 22 are shut off and the valve 36 exiting the liquid heater 22 is closed. Air compressor 12 is started and the pressure is built up to 120 psi. The air hose is connected to the air line connection at the liquid heater exiting line 35 and the air line valve 38 is turned on. After 10 seconds, air valve 38 is shut off along with all valves 40*a–d* and 42*a–d* on both manifolds 28 and 26. The same color lines 43*a–d* are disconnected at both manifolds 28 and 26. At the exiting valve 40A–D, insert the pig device and at the return manifold 26 at valves 42A–D, insert the pig device catcher. Reconnect these two ends 43*a–d* to the manifold, open the valves of this line 43*a–d* only, open air valve 38, allow two to three minutes for air to push liquid out of the lines into the reservoir 14, shut off the air 38 and the valves 40*a–d* on the line 43*a–d*. While 42A–D is being pigged by air, remove pig device catcher at the return manifold 42, check the pig device catcher for the pigging device. If for any reason the pig device is not in the catcher, check for line kinks or the line being squeezed together, repeat process. Once the pig device has reached the pig device catcher, remove pig device by pushing it back to hose end connection 42 ad with a small rod, repeat this operation with remaining lines. Valves 40*a–d* and 42*a–d* at exiting and return manifolds should be closed when the unit 10 is not in operation. Roll up one hose 43*a–d* at a time onto reels 24*a–b*, connecting lines 43*a–d* together. When one has been totally placed on reel 24*a–b*, connect second line 43*a–d* and begin reeling onto the same reel 24*a–b*.

Provide high temperature liquid to produce heat to locations with need of temporary hot liquid requirements. To supply heat through, around, under or over, using a liquid transported to location, with heat from exterior of portable Liquid Heater rubber conduits. Conditions where surface is exposed to natural elements to be insulated to capitalize on effect of heat being generated. To supply hot liquid or exterior conduit heat at 165 degrees to 200 degrees Fahrenheit. Portable delivered heat to equipment such as radiator type heaters, interior dryer type dispensers, provide heat to surfaces, such as floors, with capabilities of multilevel floors, frozen water and sewer lines, heat asphalt for installation and removal, heat ground for water drainage, excavation and trenching purposes, heat existing fluids in storage tanks, pipelines, holding ponds, swimming pools, melting ice, heating spilled products on frozen terrain, in almost any location, by unit's stand alone and portable design. Can be towed by regular vehicle or mounted on skids and dragged by heavy equipment.

The unit 11 is designed to maximize heat efficiency and fuel economy by reusing hot fluids through a circulation system, using four 500' length hoses 43*a–d*, each returning hot liquid to the liquid heater 22 for continued distribution. Lines 43*a–d* can be connected together and equipment can be inserted as desired, by simply cutting the equipment of appliances into the lines and putting in splices when a portion of the work is completed.

The device is capable of running even when one, two or three of the lines 43*a–d* have been shut down.

When relocating or moving the trailer 11, the lines 43*a–d* are to be pumped out. This allows for lighter, more flexible and more maneuverable lines 43*a–d* for lifting and redistribution or take up. Approximate time for two people to put out or take up the lines is one-half hour. Approximate time to empty all the lines 43*a–d* is 15 minutes. Hoses 43*a–d* are identified by color code for working with an individual line. Hoses 43*a–d* can be connected together and have 1000+ feet, two way, capability, with little temperature loss.

The unit 10 is designed to provide 8 different lines 43*a–d* of hot exterior of 1.10 outside diameter surface (has the capability of one 1.50 inch diameter surface) when a circulating system in use and liquid going through a conduit system, returning and re-heating and beginning cycle again. Can reach up to 1,500 feet in one direction with a standard operation of 1000 feet in one direction. Liquid temperature can reach maximum heat setting in one-half hour. Operating from a source of liquid, to pump and through system, the device 11 will maintain a desired setting and the hot liquids are supplied to another system at a rate of 1,280 gallons of hot liquid per hour.

The device provides hot liquid to remote or undeveloped sites and locations in the construction development stage. (To liquid heater such as hot liquid radiator type heaters, large air conditioning units converted to run hot liquid through coils with fans pushing hot air for heat and/or drying of concrete, plaster, paste, etc.) (To heat liquid to provide heated liquid to meet the needs requested)

To connect to large radiator type container and push hot liquid through coils and have blower type equipment push hot air under tent type cover over area to dry, melt, or heat. (System could accommodate a minimum of four units). To melt frozen ground to allow excavation to a determined depth and width, such as trenching for utilities and emergency digs, cleanup for spills on frozen terrain, pipeline repairs and other necessary valid reasons to have to excavate in frost conditions, by using the heat transferred to the exterior of the conduits carrying fluids from the liquid heater. (A type of insulation should be used to minimize any heat loss from natural climate or open exposure) (Estimated time for thawing 100 feet of frozen ground to a depth of 36 inches is 24 to 32 hours with a heat setting of 180 degrees) (Would allow for minimum spoils being removed, due to no frozen soils and debris, therefore avoiding large frozen chunks having to be removed and creating less abuse to machinery doing excavation and man hours to complete work, a logical and cost savings to all involved.)

Melt frozen areas for water drainage, culverts, sewers and water mains in the same manner as described above, using exterior heat Unthaw precise width of an area for excavation on environmentally sensitive tundra and areas where over excavation is perilous. (Can heat the top few inches within hours and therefore allowing the minimum being removed and avoiding the time delay of waiting until the ground naturally thaws and waste has been absorbed in the surrounding area, therefore enlarging the spill and the removal of waste.)

To heat frozen storage tanks, stock piles of solids, soils, waste, gate valves, conduit systems, irrigation facilities, fire valves and manhole entries and exits by using the exterior surface of conduits. To heat product in frozen conduits, pipelines, water lines, sewer lines and storage tanks and stockpiles.

To heat by-products in lines described above.

To temporarily connect to existing systems to provide hot liquid to systems with permanent appliance shut down for repairs or replacement. (such as large liquid heater units for parking facilities, domestic heat, driveways, swimming pools, in floor hot water systems) (a portable replacement)

Connect system to engines and equipment in cold climate for starting purposes, circulating hot liquid through the other cooling system.

To free frozen equipment and material from the ground and conditions exist that do not allow for excavation or other heat available.

To heat a liquid to be pumped through pipeline system to melt solids or associated materials inside.

Capability of connecting an additional liquid heater to system for the purpose of preheating fluids to primary liquid heater when a non circulating system is in use and large amounts of fluid are to be used to get hot liquid through another parties system. (Example would be heating a fluid to run through a pipeline to a holding pond and no return is available and the liquid being heated is being supplied by transporting to site. This double system insures the maximum heat being installed at all times).

To use unit's hot liquid conduits exterior to melt ice buildup in hazardous locations, private and public locations, basements, roofs, parking facilities and locations affected by other acts of God.

Connect to a continues Copper Coil predetermined in diameter for fast melting of frozen asphalt, roadway, right of way or ground, to do emergency type excavation for benefit of public and for reasons of safety. (Connections to conduits can be added for convenience of best method of operation for each service to be rendered)

Liquid pump has actual pressure from the reservoir to it, it is less than 3 feet to the liquid heater and fluid is being pushed down from the liquid heater to the manifold and four exits and back into a hose the same size, after four runs of 500 feet and flowing no more than 20 gallons a minute into a reservoir that is now warming the remaining fluids in It, from the liquid returning and now begins going back into the liquid heater at a higher temperature than the first time and is on its way back to the reservoir and putting a little bit hotter liquid into it and now the liquid going into the liquid heater almost as hot as the liquid leaving the liquid heater and after a very short period of time, all the liquid is almost the same temperature and very easy for the liquid heater to catch up.

The device is simple, effective and can operate while parts are being purchased at a local hardware store. The unit is worker friendly, lightweight and only requires, at the most, two people to operate. The unit can work in four different directions and can do the same thing with the returning line as the exit lines, allowing for eight lines of heat to an area. The unit can even heat buildings under construction while drying concrete and drywall by installing any type of liquid radiator in the lines and splicing the hoses. The hoses are light enough to keep from pulling apart however, in the event they do, the hoses would be empty, so nothing would be damaged. They can then be put back together with a screw driver. The device can heat multi-floors, roadways for emergency cuts, melt frozen culverts, thaw the ground under trailers for frozen pipes and melt ice on anything from roofs to gutters.

What is claimed is:

1. A mobile atmospheric unit for providing a heated liquid, comprising:

a liquid heater for generating a heated liquid;

a pump means for providing a circulating pressure;

a multiple conduit exit manifold communicating with said liquid heater by way of said pump means for dispensing said heated liquid;

at least one conduit, communicating with said exit manifold, for circulating said heated liquid;

an intake manifold, communicating with said at least one conduit, for return of said heated liquid; and, a return reservoir, communicating with said intake manifold and said liquid heater for maintaining the returned heated liquid and incrementally feeding said returned heated liquid to said liquid heater.

2. The method of claim 1 wherein said at least one conduit may be independently shut down by means of a valve arrangement.

3. The method of claim 1 wherein said at least one conduit is flexible for facilitating transport and storage of said mobile atmospheric unit.

4. The method of claim 1 wherein said at least one conduit communicates with at least one heat exchanger for radiating heat into the surrounding air space.

5. The method of claim 1 further comprising means for forcing air to enhance the radiated heat effect of said at least one heat exchanger.

6. The method of claim 1 wherein said at least one conduit communicates by convection with the surrounding ground space to effect heating and drying thereof.

7. The method of claim 1 wherein a biodegradable freezing point depressant is admixed with said heated liquid to retard the freezing point of said liquid.

* * * * *